US007096844B2

(12) United States Patent
Kawamoto et al.

(10) Patent No.: US 7,096,844 B2
(45) Date of Patent: Aug. 29, 2006

(54) FOUR-STROKE ENGINE LUBRICATED BY FUEL MIXTURE

(75) Inventors: Shiro Kawamoto, Texarkana, AR (US); Hugh B. McCullough, Stonewall, LA (US); Edward Mikell Wallace, Wake Village, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 159 days.

(21) Appl. No.: 10/390,965

(22) Filed: Mar. 18, 2003

(65) Prior Publication Data

US 2004/0182355 A1 Sep. 23, 2004

(51) Int. Cl.
*F01M 1/00* (2006.01)

(52) U.S. Cl. ..... 123/196 CP

(58) Field of Classification Search ..... 123/193.6, 123/196 R, 196 M, 198 CP, 196 CP; 277/451; 92/156, 158

See application file for complete search history.

(56) References Cited

U.S. PATENT DOCUMENTS

| | | | | | |
|---|---|---|---|---|---|
| 2,653,065 | A | * | 9/1953 | Appleton | 92/156 |
| 3,400,941 | A | * | 9/1968 | Hutto | 277/451 |
| 3,721,163 | A | * | 3/1973 | Hill et al. | 92/158 |
| 4,510,897 | A | | 4/1985 | Hatz et al. | |
| 4,662,322 | A | * | 5/1987 | Tamba et al. | 123/41.86 |
| 4,762,098 | A | | 8/1988 | Tamba et al. | |
| 4,969,434 | A | | 11/1990 | Nakagawa | |
| 5,058,542 | A | | 10/1991 | Grayson et al. | |
| 5,241,932 | A | | 9/1993 | Everts | |
| 5,347,967 | A | | 9/1994 | Todero et al. | |
| 5,558,057 | A | | 9/1996 | Everts | |
| 5,579,735 | A | * | 12/1996 | Todero et al. | 123/317 |
| 5,701,855 | A | | 12/1997 | Kurihara et al. | |
| 5,737,999 | A | * | 4/1998 | Ariga | 92/158 |
| 5,738,062 | A | | 4/1998 | Everts | |
| 5,950,590 | A | | 9/1999 | Everts et al. | |
| 5,992,375 | A | | 11/1999 | Nagashima | |
| 6,145,484 | A | * | 11/2000 | Funakoshi et al. | 123/73 AD |
| 6,199,532 | B1 | * | 3/2001 | Haberlein et al. | 123/196 R |
| 6,227,160 | B1 | | 5/2001 | Kurihara et al. | |
| 6,363,904 | B1 | | 4/2002 | Kurihara et al. | |
| 6,374,796 | B1 | | 4/2002 | Kawamoto et al. | |
| 6,401,701 | B1 | * | 6/2002 | Liu | 123/572 |
| 6,408,835 | B1 | * | 6/2002 | Katayama et al. | 123/572 |
| 6,536,385 | B1 | * | 3/2003 | Takashima | 123/73 C |
| 2001/0027768 | A1 | | 10/2001 | Evert et al. | |
| 2002/0121262 | A1 | | 9/2002 | Kawamoto et al. | |

* cited by examiner

*Primary Examiner*—Henry C. Yuen
*Assistant Examiner*—Jason Benton
(74) *Attorney, Agent, or Firm*—Pearne & Gordon LLP

(57) ABSTRACT

A four-stroke engine includes a piston cylinder, and a piston located in the cylinder and movable within the cylinder. The engine includes a crankcase attached to the cylinder, the piston providing a separation boundary of a combustion portion of the cylinder from the crank case, and a crank member located within the crankcase and operatively connected to the piston. The engine including components for operating the engine in a four-stroke sequence, and components for introducing a fuel mixture into the combustion portion of the cylinder, the fuel mixture having an ability to lubricate. The engine including a construction and/or configuration for promoting passage of a portion of the mixture from the combustion portion of the cylinder to the crankcase in a sufficient amount to provide lubrication within the crankcase without reservoir lubricant in the crankcase.

21 Claims, 3 Drawing Sheets

FOUR-STROKE ENGINE LUBRICATED BY FUEL MIXTURE

FIELD OF THE INVENTION

The present invention relates to a four-stroke engine, and specifically relates to a four-stroke engine that is lubricated by a fuel mixture that is supplied to the engine.

BACKGROUND OF THE INVENTION

Two major types of engines are available, and are commonly referred to as two-stroke type and four-stroke type. In general, a two-stroke engine relies upon oil mixed with gas as the input fuel to provide for lubrication within the engine. In distinction, a four-stroke engine utilizes an oil reservoir to provide for lubrication within the engine.

Regulations concerning engine emission levels are intended to minimize emmision levels. Typically, a four-stroke engine can provide a better (e.g., lower) emmission level than a two-stroke engine. However, some four-stroke engine designs are somewhat difficult to utilize for some handheld power machine applications. In particular, the presence of an oil reservoir may hamper suitability of a fourstroke engine to be utilized in an application where the engine may be subject to large tilting angles or even inversion. Thus there is a need to address these issues.

SUMMARY OF THE INVENTION

In accordance with one aspect, the present invention provides a four-stroke engine that includes a piston cylinder, and a piston located in the cylinder and movable within the cylinder. The engine includes a crankcase attached to the cylinder, the piston providing a separation boundary of a combustion portion of the cylinder from the crank case, and a crank member located within the crankcase and operatively connected to the piston. The engine includes means for operating the engine in a four-stroke sequence, and means for introducing a fuel mixture into the combustion portion of the cylinder, the fuel mixture having an ability to lubricate. The engine includes means for promoting passage of a portion of the mixture from the combustion portion of the cylinder to the crankcase in a sufficient amount to provide lubrication within the crankcase without reservoir lubricant in the crankcase.

BRIEF DESCRIPTION OF THE DRAWINGS

The forgoing and other features and advantages of the present invention will become apparent to those skilled in the art to which the present invention relates upon reading the following description with reference to the accompanying drawings, wherein.

DESCRIPTION OF EXAMPLE EMBODIMENT

Figure 1:
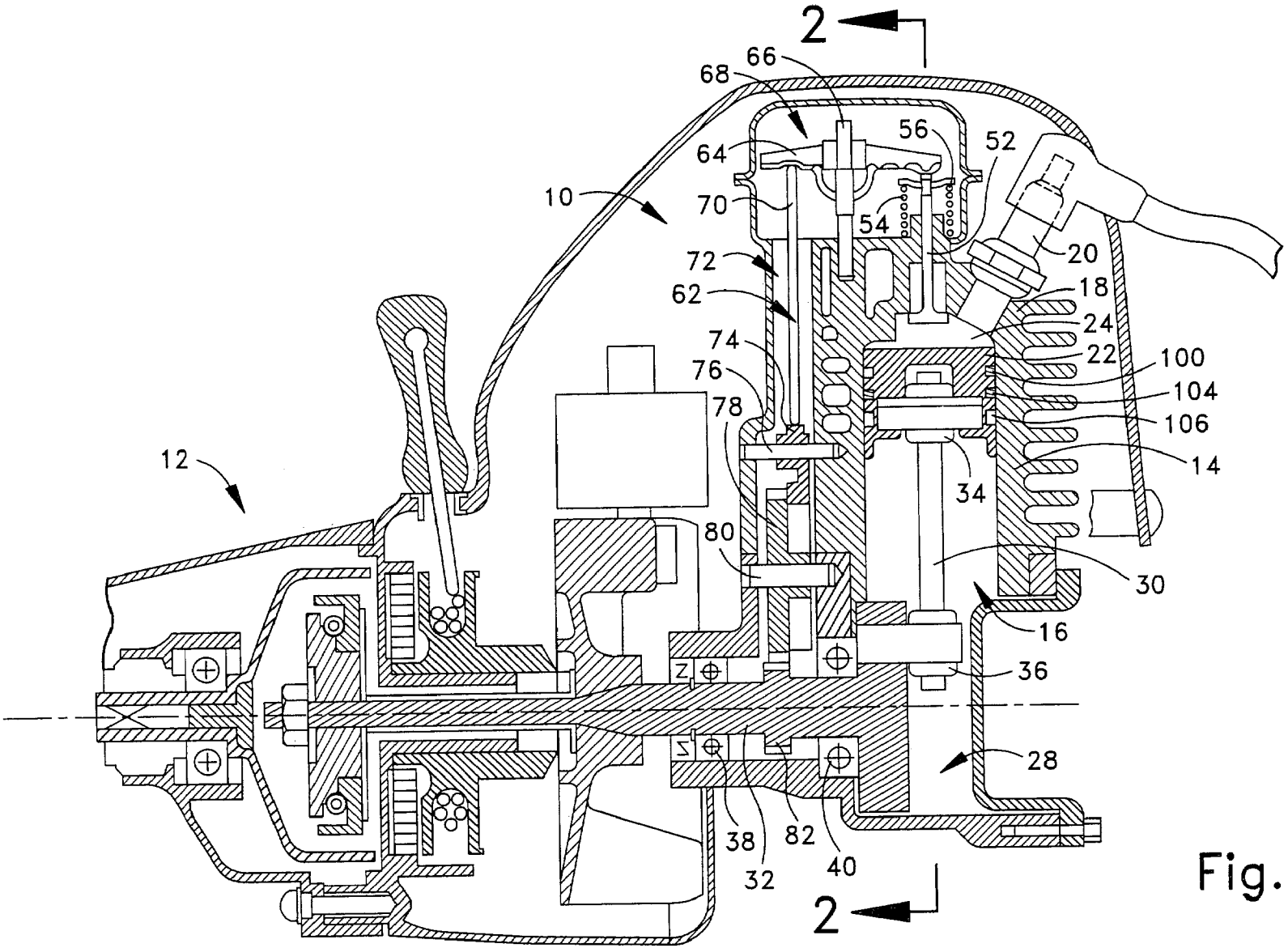
FIG. 1 is a schematic section view of a four-stroke engine in accordance with the present invention.

One example of a four stroke engine 10, in accordance with the present invention, is schematically shown in FIG. 1. In the shown example, the engine 10 is part of a hand-held power tool 12, such as a trimmer. Some of the other structure of the hand-held power tool 12 is illustrated to shown one possible environment for the present invention. However, it is to be apprecaited that such other structure and the environment are not limitations on the present invention. It is to be noted that the present invention may be utilized in any engine application.

The engine 10 includes a cylinder block 14 that has a cylinder 16. A cylinder head 18 encloses one end of the cylinder 16. An ignition device 20 (e.g., a spark plug) extends into the cylinder 16. A piston 22 is located within the cylinder 16 and is movable relative to the cylinder block 14. The piston 22 encloses a combustion chamber portion of the cylinder 16.

The cylinder 16 opens into a crankcase 28 of the engine 10. A connecting rod 30 extends between the piston 22 and a crankshaft 32 within the crankcase 28. The connecting rod 30 is operatively connected to the piston 22 and the crankshaft 32 via respective bearings 34, 36. The crankshaft 32 is supported for rotation via suitable bearings 38, 40, and is operatively connected to deliver rotational force to another portion (e.g., a trimmer head drive shaft) of the power tool 12.

An air cleaner box 44 (FIG. 2), with an air cleaner element 46 located therein is associated with a carburetor 48. In turn, the carburetor 48 supplies a fuel mixture that is ignited by the ignitor device 20 (FIG. 1) for combustion within the combustion chamber portion 24 of the cylinder 16. The ignition of the fuel mixture forces the piston 22 to move within the cylinder 16, which in turn causes the crankshaft 32 to rotate, as will be appreciated by the person of ordinary skill in the art.

Focusing on the fuel mixture, the mixture includes both a combustion component/aspect and a lubricating component/aspect. In one example, the fuel mixture includes gasoline, commonly referred to as gas, and oil. The carburetor 48 (FIG. 2) atomizes the fuel mixture and introduces the fuel mixture into an air stream. Hereinafter, the combination of the fuel mixture (e.g., gas and oil) and the air is referred to simply as the fuel mixture, with the understanding that air is present in the mixture.

An intake passage 50 extends from the carburetor 48, through the cylinder block 14 and/or the cylinder head 18, toward the cylinder 16. An intake valve 52 is mounted in the cylinder head 18 and is in communication with the intake passage 50 and the combustion chamber portion 24 of the cylinder 16. The intake valve 52 is operable to open and permit flow of the fuel mixture into the the combustion chamber portion 24 of the cylinder 16. In the shown example, the intake valve 52 is a poppet valve. A valve spring 54 extends between a valve retainer 56 secured to the valve 52 and the cylinder head 18, or a spring seat (not shown) on the cylinder head, to bias the valve into a closed position. An exhaust valve 58 is provided and operativelty connected similar to the intake valve 52. The exhaust valve 58 functions to vent combustion gases from the cylinder, as will be appreciated the person of ordinary skill in the art. As discussed above for the shown example, the carburetor 48 provides the fuel mixture, and the fuel mixture passes through the intake passage 50, and through the open intake valve 52 into the combustion chamber portion 24 of the cylinder 16. However, it should be noted that different configurations for supplying the fuel mixture into the combustion chamber portion 24 of the cylinder 16 are possible and contemplated. For example, the carburetor 48 could be eliminated or modified, and gas and oil could be injected into the combustion chamber portion 24 of the cylinder 16, with air only being delivered via the intake valve 52. Such other fuel mixture deliver configurations are intended to be within the scope of the present invention.

Turning back to the shown example, the intake and exhaust valves 52 and 58 are each respectively connected to a valve drive train 62. Only the valve drive train 62 (FIG. 1) for the intake valve 52 is shown, but it is to be understood that similar structure exists for the exhaust valve 58. Within the drive train 62, a rocker arm 64 is mounted for pivot movement on a pivot mount 66 located within a valve chamber 68. One end of the rocker arm 64 is engaged with the valve 52 and is operable to move the valve (e.g., down as viewed in FIG. 1) and open the valve against the bias of the spring 54.

A push rod 70 extends through a passage 72 in the cylinder block 14. The push rod 70 is in engagement with the another end of the rocker arm 64 and is operable to push (e.g., upward as viewed in FIG. 1) and pivot the rocker arm. A cam follower 74 is located within the passage 72 within the cylinder block 14, and is in engagement with the push rod 70. The cam follower 74 is constrained for movement relative to the cylinder block 14 via a cam follower pin 76, and can transfer a movement force (e.g., in the upward direction as viewed in FIG. 1) to the push rod 70.

A cam gear 78 is located in the passage 72 within the cylinder block 14, and is supported for movement relative to the cylinder block via a cam gear pin 80. The cam gear 78 is in engagement with the cam follower 74 and is in engagement with a crank gear 82 on the crankshaft 32. The cam gear 78 transfers force to the cam follower 74 in response to rotation of the crankshaft 32. It is to be appreciated that the drive train 62 may have a different construction, configuration, etc.

The drive train 62 is configured to cause operation of the intake valve 52 in a four-stroke engine sequence. Specifically, the timing of operation of the intake valve 52 is provided to be in the four-stroke engine sequence. The exhaust valve (FIG. 2) is similarly operated in the four-stroke engine sequence.

The passage 72 (FIG. 1), through which the drive train 62 extends, connects the crankcase 28 with the valve chamber 68. The passage 72 permits fluid (e.g., gaseous) flow between the crankcase 28 and the valve chamber 68. Specifically, the passage 72 is sized to permit the fluid flow adjacent and past all of the components 64–82 in the drive train 62. A similar fluid flow exists for the drive train components for the exhaust valve.

Figure 2:
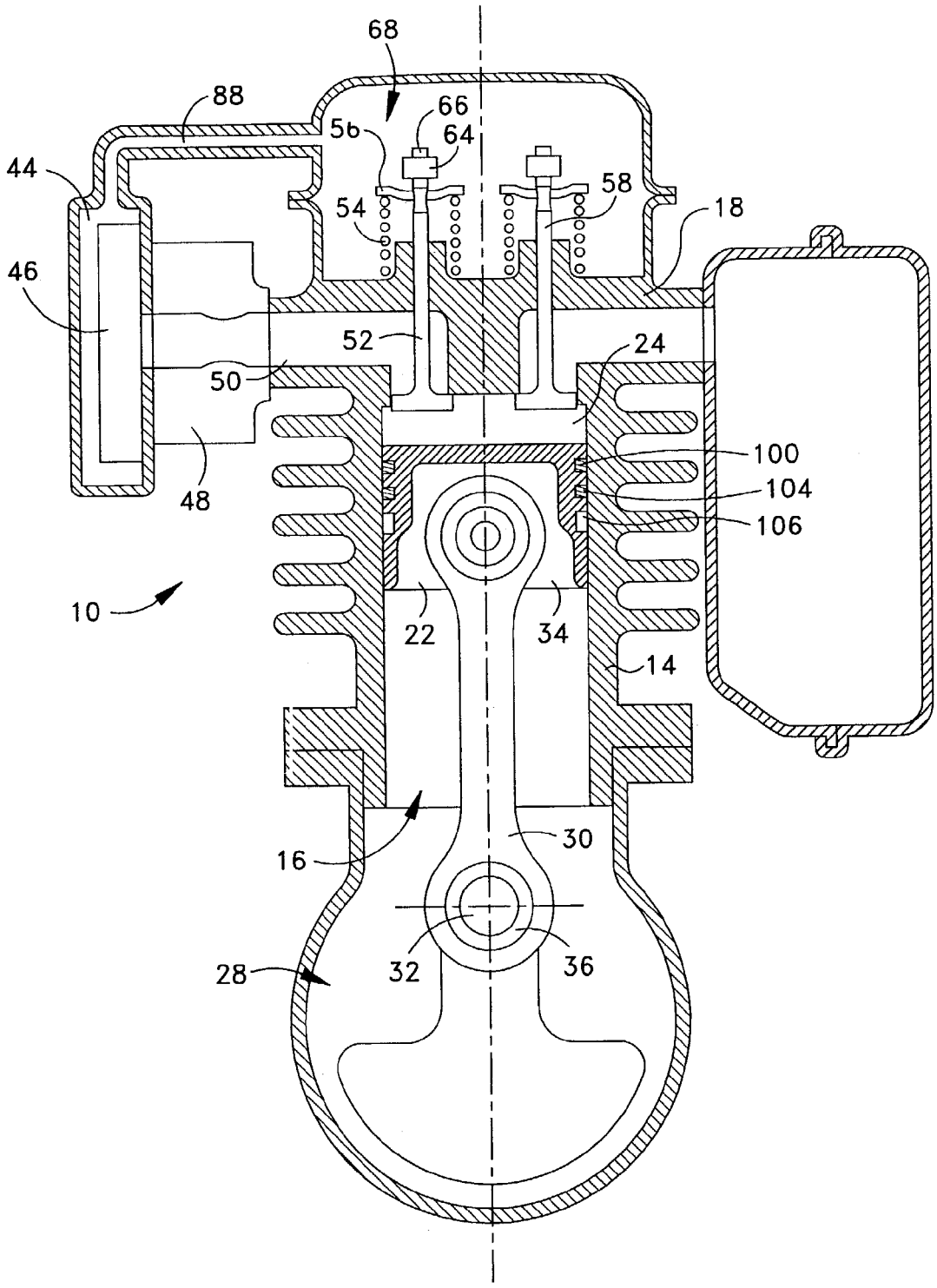
FIG. 2 is a schematic section view of the four-stroke engine of FIG. 1, taken along line 2–2 in FIG. 1.
Figure 3:
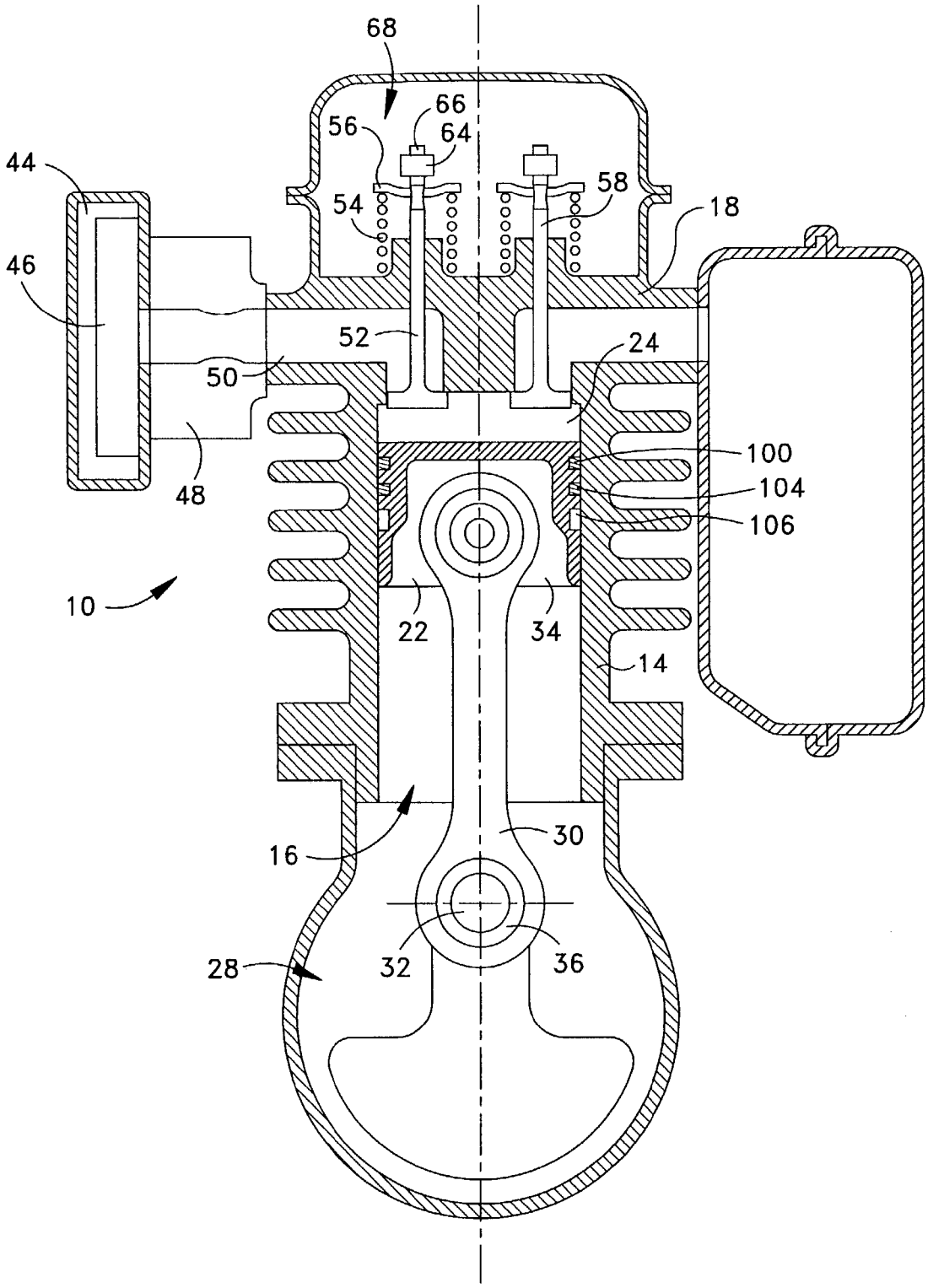
FIG. 3 is a view similar to FIG. 2, but shows another embodiment of the present invention.

In the embodiment of FIG. 2, a breather valve 88 extends from the valve chamber 68 to the air cleaner box 44. The breather valve 88 aids fluid (e.g., gaseous) flow from the crankcase 28 to the valve chamber 68 and also provides a means to direct gaseous content from the valve chamber into the air cleaner box 44 to become part of the stream of fuel mixture for combustion within the engine 10. However, the embodiment of FIG. 3 omits the breather valve such that routing of gaseous content to the air cleaner box 44 does not occur.

It is to be noted that the four-stroke engine 10 according to the present invention is configured to operate without a separately provided lubricating oil supply. Specifically, there is not separate oil supply in the crankcase 28. Lubrication of the four-stroke engine is provided by a portion of the fuel mixture that passes from the combustion chamber portion 24 of the cylinder 16, past the piston 22, and into the crankcase 28. Within the crankcase 28, the portion of the fuel mixture provides lubrication for parts located in the crankcase and open to the crankcase, such as the connecting rod bearings 34, 36. From the crankcase 28, some of the portion of the fuel mixture that enters the crankcase progresses along the passage 72 for the valve drive train 62 to the valve chamber 68. As such, the drive train components 64–82 and the valves 52, 58 are lubricated.

In one example, the portion of the fuel mixture that passes from the combustion chamber portion 24 of the cylinder 16, past the piston 22, and into the crankcase 28 is an oil or oily ingredient of the fuel mixture. Hereinafter, the portion of the fuel mixture that passes from the combustion chamber portion 24 of the cylinder 16, past the piston 22, and into the crankcase 28 is referred to simply as oil. The oil is conveyed by blow-by gas that proceeds past the piston 22. Sufficient oil must be conveyed past the piston 22 in order to accomplish needed lubrication.

The movement of sufficient oil is accomplished via one or more constructions and/or configurations associated with the interaction between the piston 22 and the cylinder block 14. The constructions and/or configurations promote the movement of the oil past the piston 22 and into the crankcase 28. In the shown example, three separate constructions and/or configurations are provided. It is to be appreciated that less than all three (e.g., only one) construction and/or configuration may be utilized, and that a construction and/or configuration different than the example constructions and/or configurations may be utilized.

Turning to the shown examples, the first example is the use of a piston ring 100 that has a notably large end-gap 102 that permits a proportionately large amount of oil conveying blow-by gas to proceed past the piston 22. The piston ring 100 is mounted in an annular groove in the piston 22, and engages the cylinder wall to provide for a sealing function between the piston and cylinder block 14, except at the location of the ring end-gap 102. The end-gap 102 of the ring is provided in that the ring is not a complete circle when mounted on the piston. Thus, the end-gap 102 extends along an arc segment about a center axis of the piston. The size of the end-gap (i.e., arc length) is chosen for desired amount of blow-by gas to proceed past the piston 22.

The second example is the use of one or more oil scraping rings 104 (only one shown). Each oil scraping ring 104 is mounted in an annular groove in the piston 22. As the piston 22 moves within the cylinder 16, each oil scraping ring 104 scrapes oils that is clinging to the wall of the cylinder toward the crankcase 28. The oil scraping rings 104 may have any construction that accomplishes the function of scraping oil toward the crankcase 28. For example, each oil scraping ring 104 has a taper to accomplish the directional scraping functions The third example is the presence of an annular oil-reserving groove 106 in piston. The oil-reserving groove 106 provides an area that holds oil.

From the above description of the invention, those skilled in the art will perceive improvements, changes and modifications. Such improvements, changes and modifications within the skill of the art are intended to be covered by the appended claims.

What is claimed:

1. A four-stroke engine including:

a piston cylinder;

a piston located in the cylinder and movable within the cylinder; a crankcase attached to the cylinder, the piston providing a separation boundary of a combustion portion of the cylinder from the crank case;

a crank member located within the crankcase and operatively connected to the piston;

means for operating the engine in a four-stroke sequence;

means for introducing a fuel mixture into the combustion portion of the cylinder, the fuel mixture having an ability to lubricate;

means for promoting passage of a portion of the mixture from the combustion portion of the cylinder to the crankcase in a sufficient amount to provide lubrication within the crankcase without reservoir lubricant in the crankcase;

wherein the portion of the mixture contains an oily substance, and the means for promoting passage of a portion of the mixture from the combustion portion of the cylinder to the crankcase promotes passage of the oily substance; and wherein the means for promoting passage of a portion of the mixture from the combustion portion of the cylinder to the crankcase includes an open gap in a piston ring on the piston.

2. A four-stroke engine including:

a piston cylinder;

a piston located in the cylinder and movable within the cylinder;

a crankcase attached to the cylinder, the piston providing a separation boundary of a combustion portion of the cylinder from the crank case;

a crank member located within the crankcase and operatively connected to the piston;

means for operating the engine in a four-stroke sequence;

means for introducing a fuel mixture into the combustion portion of the cylinder, the fuel mixture having an ability to lubricate;

means for promoting passage of a portion of the mixture from the combustion portion of the cylinder to the crankcase in a sufficient amount to provide lubrication within the crankcase without reservoir lubricant in the crankcase;

wherein the portion of the mixture contains an oily substance, and the means for promoting passage of a portion of the mixture from the combustion portion of the cylinder to the crankcase promotes passage of the oily substance; and wherein the means for promoting passage of a portion of the mixture from the combustion portion of the cylinder to the crankcase includes an oil reserving.

3. A four-stroke engine including:

a piston cylinder;

a piston located in the cylinder and movable within the cylinder;

a crankcase attached to the cylinder, the piston providing a separation boundary of a combustion portion of the cylinder from the crank case;

a crank member located within the crankcase and operatively connected to the piston;

means for operating the engine in a four-stroke sequence;

means for introducing a fuel mixture into the combustion portion of the cylinder, the fuel mixture having an ability to lubricate;

means for promoting passage of a portion of the mixture from the combustion portion of the cylinder to the crankcase in a sufficient amount to provide lubrication within the crankcase without reservoir lubricant in the crankcase;

wherein the portion of the mixture contains an oily substance, and the means for promoting passage of a portion of the mixture from the combustion portion of the cylinder to the crankcase promotes passage of the oily substance; and wherein the means for promoting passage of a portion of the mixture from the combustion portion of the cylinder to the crankcase includes an oil scraping ring on the piston.

4. A four-stroke engine including:

a piston cylinder;

a piston located in the cylinder and movable within the cylinder;

a crankcase attached to the cylinder, the piston providing a separation boundary of a combustion portion of the cylinder from the crank case;

a crank member located within the crankcase and operatively connected to the piston;

means for operating the engine in a four-stroke sequence;

means for introducing a fuel mixture into the combustion portion of the cylinder, the fuel mixture having an ability to lubricate;

means for promoting passage of a portion of the mixture from the combustion portion of the cylinder to the crankcase in a sufficient amount to provide lubrication within the crankcase without reservoir lubricant in the crankcase;

wherein the portion of the mixture contains an oily substance, and the means for promoting passage of a portion of the mixture from the combustion portion of the cylinder to the crankcase promotes passage of the oily substance; and wherein the means for promoting passage of a portion of the mixture from the combustion portion of the cylinder to the crankcase includes at least one of an open gap in a piston ring of the piston, an oil reserving groove on the piston, and an oil scraping ring on the piston.

5. A four-stroke engine including:

a piston cylinder;

a piston located in the cylinder and movable within the cylinder;

a crankcase attached to the cylinder, the piston providing a separation boundary of a combustion portion of the cylinder from the crank case;

a crank member located within the crankcase and operatively connected to the piston;

means for operating the engine in a four-stroke sequence;

means for introducing a fuel mixture into the combustion portion of the cylinder, the fuel mixture having an ability to lubricate;

means for promoting passage of a portion of the mixture from the combustion portion of the cylinder to the crankcase in a sufficient amount to provide lubrication within the crankcase without reservoir lubricant in the crankcase;

wherein the portion of the mixture contains an oily substance, and the means for promoting passage of a portion of the mixture from the combustion portion of the cylinder to the crankcase promotes passage of the oily substance; and wherein the oily substance is part of a gaseous mixture, and the means for promoting passage of a portion of the mixture from the combustion portion of the cylinder to the crankcase promotes passage of the gaseous mixture as a blow-by gas past the piston.

6. A four-stroke engine as set forth in claim 1, wherein the means for introducing a fuel mixture into the combustion portion includes an operable intake valve, and the means for operating the engine includes means for controlling operation of the intake valve as part of the four-stroke sequence.

7. A four-stroke engine as set forth in claim 6, wherein the engine includes means for directing passage of some of the passed portion of the mixture from the crankcase to lubricate the intake valve.

8. A four-stroke engine as set forth in claim 7, wherein the engine includes a drive train for operating the intake valve from the crankcase, and includes means for directing passage of some of the passed portion of the mixture to lubricate the drive train.

9. A four-stroke engine including:

a piston cylinder;

a piston located in the cylinder and movable within the cylinder;

a crankcase attached to the cylinder, the piston providing a separation boundary of a combustion portion of the cylinder from the crank case;

a crank member located within the crankcase and operatively connected to the piston;

means for operating the engine in a four-stroke sequence;

means for introducing a fuel mixture into the combustion portion of the cylinder, the fuel mixture having an ability to lubricate;

means for promoting passage of a portion of the mixture from the combustion portion of the cylinder to the crankcase in a sufficient amount to provide lubrication within the crankcase without reservoir lubricant in the crankcase;

wherein the means for introducing a fuel mixture into the combustion portion includes an operable intake valve, and the means for operating the engine includes means for controlling operation of the intake valve as part of the four-stroke sequence;

wherein the engine includes means for directing passage of some of the passed portion of the mixture from the crankcase to lubricate the intake valve; and wherein the means for introducing a fuel mixture into the combustion portion includes a carburetor system, and the engine includes means for directing passage of some of the passed portion of the mixture not used to lubricate the intake valve to the carburetor.

10. A four-stroke engine as set forth in claim 1, wherein the means for introducing a fuel mixture into the combustion portion of the cylinder introduces a gas and oil fuel mixture.

11. A four-stroke cycle internal combustion engine comprising:

means for providing lubrication from a portion of combustion chamber vapors by passing a piston and ring arrangement; and fuel containing a lubrication in a defined pre-mix ratio, wherein the internal combustion engine does not include an oil reservoir.

12. A four-stroke engine as set forth in claim 11, wherein a portion of the by pass vapors lubricate components of the engine.

13. A four-stroke engine as set forth in claim 11, wherein at least one piston ring and end gap combination are adapted to control an amount of the by pass vapor that passes the piston and ring arrangement.

14. A four-stroke engine as set forth in claim 11, wherein the piston contains at least one compression ring with an open end gap.

15. A four-stroke engine as set forth in claim 11, wherein the piston contains at least one compression ring with an open end gap and a second compression or scraper ring.

16. A four-stroke engine as set forth in claim 11, wherein the piston contains at least one compression ring with an open end gap and a second compression or scraper ring wherein a bottom ring groove is an oil reserving groove that allows the by pass vapors to lubricate a top rod bearing.

17. A four-stroke engine as set forth in claim 11, wherein component lubrication is obtained via the by pass vapor flow that is being pumped via engine power and intake stroke past the piston and ring arrangement.

18. A four-stroke engine as set forth in claim 11, wherein pumped by pass vapor condenses on engine components, thereby providing lubrication.

19. A four-stroke engine as set forth in claim 11, wherein excess by pass vapor is reintroduced into fresh atomized fuel/air mixture via an air filter housing.

20. A four-stroke engine as set forth in claim 11, wherein excess by pass vapor is reintroduced into fresh atomized fuel/air mixture via a carburetor.

21. A four-stroke engine as set forth in claim 11, wherein excess by pass vapor is reintroduced into fresh atomized fuel/air mixture via an intake manifold.

* * * * *